US009097473B2

(12) United States Patent
Murayama et al.

(10) Patent No.: US 9,097,473 B2
(45) Date of Patent: Aug. 4, 2015

(54) CERAMIC HEAT EXCHANGER AND METHOD OF PRODUCING SAME

(75) Inventors: Motohide Murayama, Iruma (JP); Kousuke Isomura, Tokyo (JP); Sazo Tsuruzono, Kirishima (JP)

(73) Assignee: IHI CORPORATION (JP)

( * ) Notice: Subject to any disclaimer, the term of this patent is extended or adjusted under 35 U.S.C. 154(b) by 915 days.

(21) Appl. No.: 13/257,827

(22) PCT Filed: Mar. 23, 2010

(86) PCT No.: PCT/JP2010/054924

§ 371 (c)(1),
(2), (4) Date: Nov. 7, 2011

(87) PCT Pub. No.: WO2010/110238

PCT Pub. Date: Sep. 30, 2010

(65) Prior Publication Data

US 2012/0048524 A1 Mar. 1, 2012

(30) Foreign Application Priority Data

Mar. 23, 2009 (JP) ..... 2009-069965

(51) Int. Cl.
*F28F 21/04* (2006.01)
*F28F 7/02* (2006.01)

(52) U.S. Cl.
CPC . *F28F 21/04* (2013.01); *F28F 7/02* (2013.01); *Y10T 29/4935* (2015.01)

(58) Field of Classification Search
CPC ..... F28F 7/02; F28F 21/04; F01N 3/2828; Y10S 165/395; Y10T 29/4935
USPC ..... 165/157, 164, 165, 56; 502/527.18; 422/200, 201, 202, 222
See application file for complete search history.

(56) References Cited

U.S. PATENT DOCUMENTS 3,315,739 A * 4/1967 Kearney ..... 165/165
4,265,302 A * 5/1981 Forster et al. ..... 165/165

(Continued)

FOREIGN PATENT DOCUMENTS

GB 2115916 A * 9/1983
JP 61-39285 3/1986

(Continued)

*Primary Examiner* — Tho V Duong
(74) *Attorney, Agent, or Firm* — Volpe and Koenig, P.C.

(57) ABSTRACT

To provide a ceramic heat exchanger which has reduced joints, and thus, is easy to produce and less likely to leak and a method of producing same.

The ceramic heat exchanger 1 according to the present invention comprises a body 2 having first channels 21 for a high-temperature medium to flow and second channels 22 for a low-temperature medium to flow, and lids 3 each having openings 31, joined to the body 2 at opposite ends 2*a*, 2*b* with the openings 31 connected to the first channels 21, the body 2 further having inlet channels 23 formed in a first channel 21 outlet-side end portion 2*a* to allow the low-temperature medium to enter the body at a side thereof and flow into the second channels 22, and outlet channels 24 formed in a first channel 21 inlet-side end portion 2*b* to allow the low-temperature medium to flow out of the second channels 22 and leave the body at the side thereof.

7 Claims, 7 Drawing Sheets

(56) References Cited

U.S. PATENT DOCUMENTS

| | | | | |
|---|---|---|---|---|
| 4,271,110 | A * | 6/1981 | Minjolle | 264/629 |
| 4,850,426 | A * | 7/1989 | Fayolle et al. | 165/111 |
| 5,034,023 | A * | 7/1991 | Thompson | 205/634 |
| 5,373,634 | A * | 12/1994 | Lipp | 29/890.03 |
| 5,416,057 | A * | 5/1995 | Lipp et al. | 502/439 |
| 2004/0261379 | A1* | 12/2004 | Bruun et al. | 55/418 |
| 2009/0056924 | A1* | 3/2009 | Inatomi et al. | 165/166 |

FOREIGN PATENT DOCUMENTS

| | | |
|---|---|---|
| JP | 01-146624 | 6/1989 |
| JP | 07-151478 | 6/1995 |
| JP | 10-029876 | 2/1998 |
| JP | 2002-350092 | 4/2002 |
| JP | 2002-107072 | 10/2002 |
| JP | 2005-127646 | 5/2005 |
| JP | 2005-289744 | 10/2005 |

* cited by examiner (A)

(B)

(A)

(B)

CERAMIC HEAT EXCHANGER AND METHOD OF PRODUCING SAME

TECHNICAL FIELD

This invention relates to a ceramic heat exchanger and a method of producing same, and particularly, a ceramic micro-channel counter-flow heat exchanger and a method of producing same.

BACKGROUND ART

Ceramic is a material suitable for heat exchangers because of its light weight compared with metals and good thermal conductance. Particularly because of its good heat resistance, ceramic is regarded as a promising material for use in recovery of heat from high-temperature gases above 800° C., such as exhaust gases from gas turbines or others. Commonly used in high-temperature applications are metallic plate-fin heat exchangers, which exhibit high effectiveness, but have a drawback that complicated fin shapes lead to high costs. Ceramic is, however, a material difficult to work into complicated shapes because of its high hardness and brittleness. Heat exchangers using ceramic having such properties have already proposed, as seen in patent documents 1 to 3, for example.

The ceramic heat exchanger disclosed in patent document 1 is an integrally-fired ceramic product comprising an outer frame and walls defining a plurality of channels inside the frame, intended to force a high-temperature fluid and a low-temperature fluid to flow through the channels in opposite directions to transfer heat from the high-temperature fluid to the low-temperature fluid via the walls.

The ceramic heat exchanger disclosed in patent document 2 is a sintered product produced by forming a plurality of grooved plate-form shapes from a mixture of silicon carbide powder, carbon powder and a binder, then forming a stack of the grooved plate-form shapes by provisionally bonding them with a bonding agent, the stack having minute holes formed of the grooves, then degreasing, or removing the binder from the stack, then heating, then impregnating the stack with molten silicon, and then reaction-sintering the stack.

The ceramic heat exchanger disclosed in patent document 3 comprises a casing for exhaust gases to flow through, and a plurality of tubes fitted to the casing to extend through the opposite end walls of the casing and across the interior of the casing, the tubes being intended to contain and circulate a heat medium in the direction from an exhaust gases outlet side to an exhaust gases inlet side, wherein spaces between the tubes and the end walls of the casing are filled with a liquid-form ceramic material which is matured into a ceramic, or filled with a solid-form ceramic material which is impregnated with a liquid-form ceramic material and matured into a ceramic.

PRIOR-ART DOCUMENT

Patent Document

Patent document 1: Japanese Patent Application Laid-open No. 2002-107072 Publication Patent document 2: Japanese Patent Application Laid-open No. 2005-289744 Publication Patent document 3: Japanese Patent Application Laid-open No. Hei 10-29876 Publication

SUMMARY OF THE INVENTION

Problem to be Solved by the Invention

The ceramic heat exchanger disclosed in patent document 1 has channels in a grid array for high-temperature and low-temperature fluids to flow in the opposite directions. How to introduce the high-temperature and low-temperature fluids into the channels in the ceramic heat exchanger is however not described specifically. The ceramic heat exchanger disclosed in patent document 2 is produced by stacking and joining a plurality of grooved plate-form shapes together, wherein channels are formed of grooves of the grooved plate-form shapes. This ceramic heat exchanger has a lot of joints, and thus, requires a lot of production steps and has a high likelihood of leakage. The ceramic tube heat exchanger disclosed in patent document 3 contains complicated joints between the casing and the tubes, and thus, requires a lot of production steps and has a high likelihood of leakage.

The present invention has been made in consideration of the above problems. An object of the present invention is to provide a ceramic heat exchanger which has reduced joints, and thus, is easy to produce and less likely to leak, and a method of producing same.

Means for Solving the Problem

The present invention provides a ceramic heat exchanger made of ceramic, for forcing a first medium and a second medium, different in temperature, to flow in opposite directions to transfer heat between the first and second media, comprising: a body having first channels for the first medium to flow and second channels for the second medium to flow, and lids each having openings, joined to the body at opposite ends with the openings connected to the first channels, the body further having inlet channels formed in a first channel outlet-side end portion to allow the second medium to enter the body at a side thereof and flow into the second channels, and outlet channels formed in a first channel inlet-side end portion to allow the second medium to flow out of the second channels and leave the body at the side thereof.

The first and second channels may form alternating rows. The first and second channels may form a grid or honeycomb structure. The first and second channels may have a cross-section shape consisting of long and short sides. The ratio of the long side to the short side of the cross-section shape is desirably between 1.2 and 3.0.

The inlet channels as well as the outlet channels may be grooves formed in the body and delimited by an inner side of the lid, the grooves extending transversely across the body and connecting to the second channels. The outlet channels may be greater in capacity than the inlet channels.

The ceramic heat exchanger may further comprise a cylindrical member arranged over the body, the cylindrical member providing an inlet chamber connecting to the inlet channels and having an inlet for the second medium to flow in, and an outlet chamber connecting to the outlet channels and having an outlet for the second medium to flow out.

The present invention also provides a method of producing a ceramic heat exchanger made of ceramic for forcing a first medium and a second medium, different in temperature, to flow in opposite directions to transfer heat between the first and second media, comprising: a forming step of forming a body-forming shape having first channels for the first medium to flow and second channels for the second medium to flow, and lid-forming shapes each having openings to be connected to the first channels, a sintering step of sintering the body-forming shape and the lid-forming shapes, thereby producing a body-forming sintered block and lid-forming sintered blocks, a working step of creating grooves connecting to the second channels, in opposite end portions of the body-forming sintered block, transversely across the body-forming sintered block, an application step of applying a bonding agent to joint surfaces of at least either the body-forming sintered block or the lid-forming sintered blocks, and a heat treatment step of heat-treating the body-forming sintered block with the lid-forming sintered blocks placed on opposite ends thereof, with the openings in agreement with the first channels, thereby integrating the body-forming sintered block and the lid-forming sintered blocks by virtue of the bonding agent.

Effect of the Invention

In the ceramic heat exchanger and the method of producing same according to the present invention, the ceramic heat exchanger is composed of a body and lids, and produced by joining only the body and the lids. Such ceramic heat exchanger has reduced joints, and thus, is easy to produce and less likely to leak.

BRIEF DESCRIPTION OF THE DRAWINGS

FIG. 1 shows an embodiment of a ceramic heat exchanger according to the present invention, wherein FIG. 1(A) is a side view and FIG. 1(B) is a view as viewed in the direction of arrow B in FIG. 1(A), FIG. 2 shows cross-sectional views of the ceramic heat exchanger shown in FIG. 1(A), wherein FIG. 2(A) is a cross-sectional view along line SA-SA and FIG. 2(B) is a cross-sectional view along line SB-SB, FIG. 3 shows sintered blocks obtained by a method of producing a ceramic heat exchanger according to the present invention, wherein FIG. 3(A) shows a body-forming sintered block after a sintering step, FIG. 3(B) shows the body-forming sintered block after a working step, and FIG. 3(C) shows the body-forming sintered block after an application step and a lid-forming sintered block to be joined to it, FIG. 4 shows applications of the ceramic heat exchanger according to the present invention, wherein FIG. 1(A) shows a first application and FIG. 1(B) shows a second application, FIG. 5 shows variants of the ceramic heat exchanger according to the present invention, wherein FIG. 5(A) is a side view showing a first variant and FIG. 5(B) is a cross-sectional view showing a second variant, FIG. 6 shows a third variant of the ceramic heat exchanger according to the present invention, wherein FIG. 6(A) shows an end of a body, FIG. 6(B) shows a face of a lid, and FIG. 6(C) shows an end face of a ceramic heat exchanger, and FIG. 7 shows further variants of the ceramic heat exchanger according to the present invention, wherein FIG. 7(A) shows a fourth variant and FIG. 7(B) shows a fifth variant.

MODE OF CARRYING OUT THE INVENTION

Figure 1:
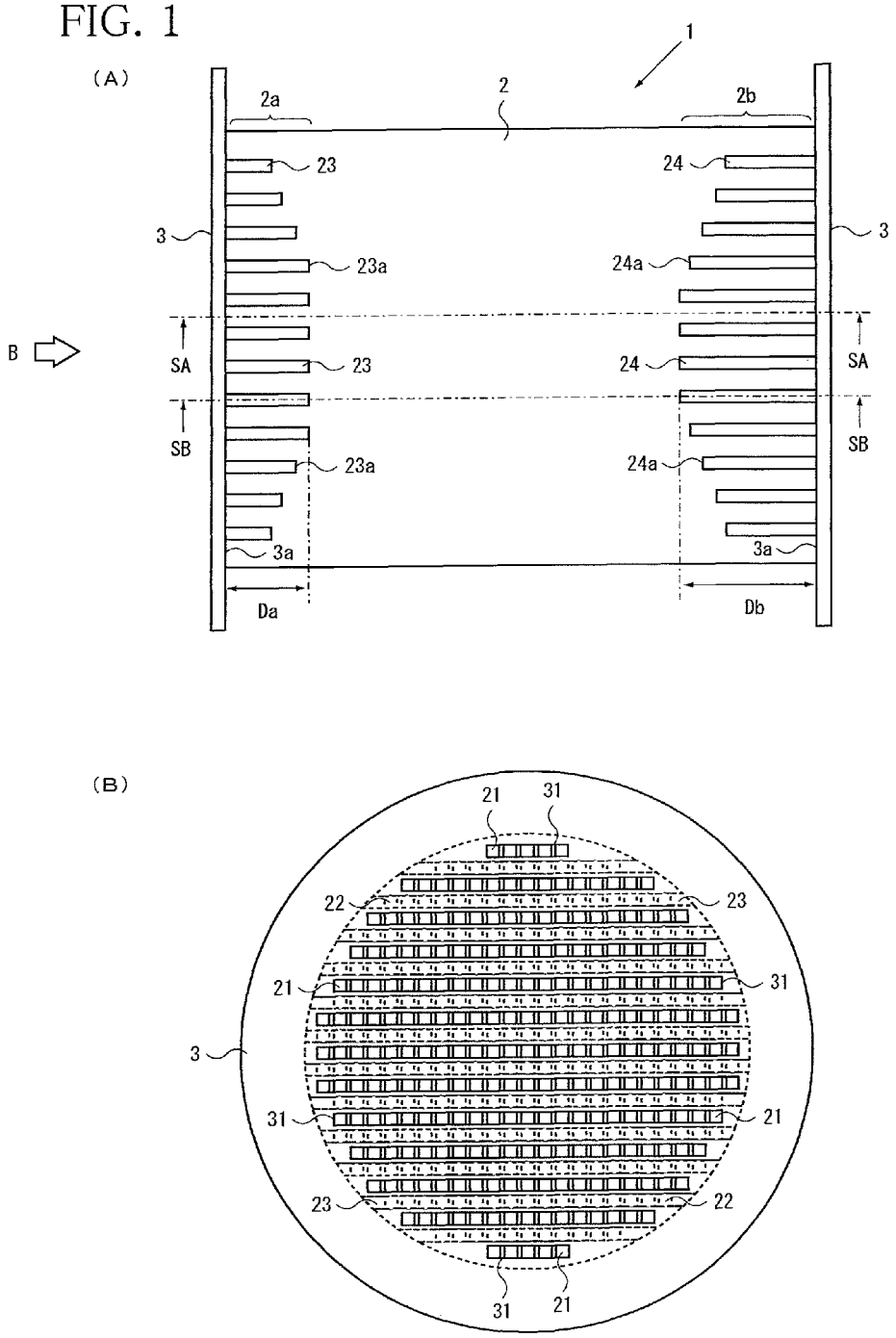
Figure 2:
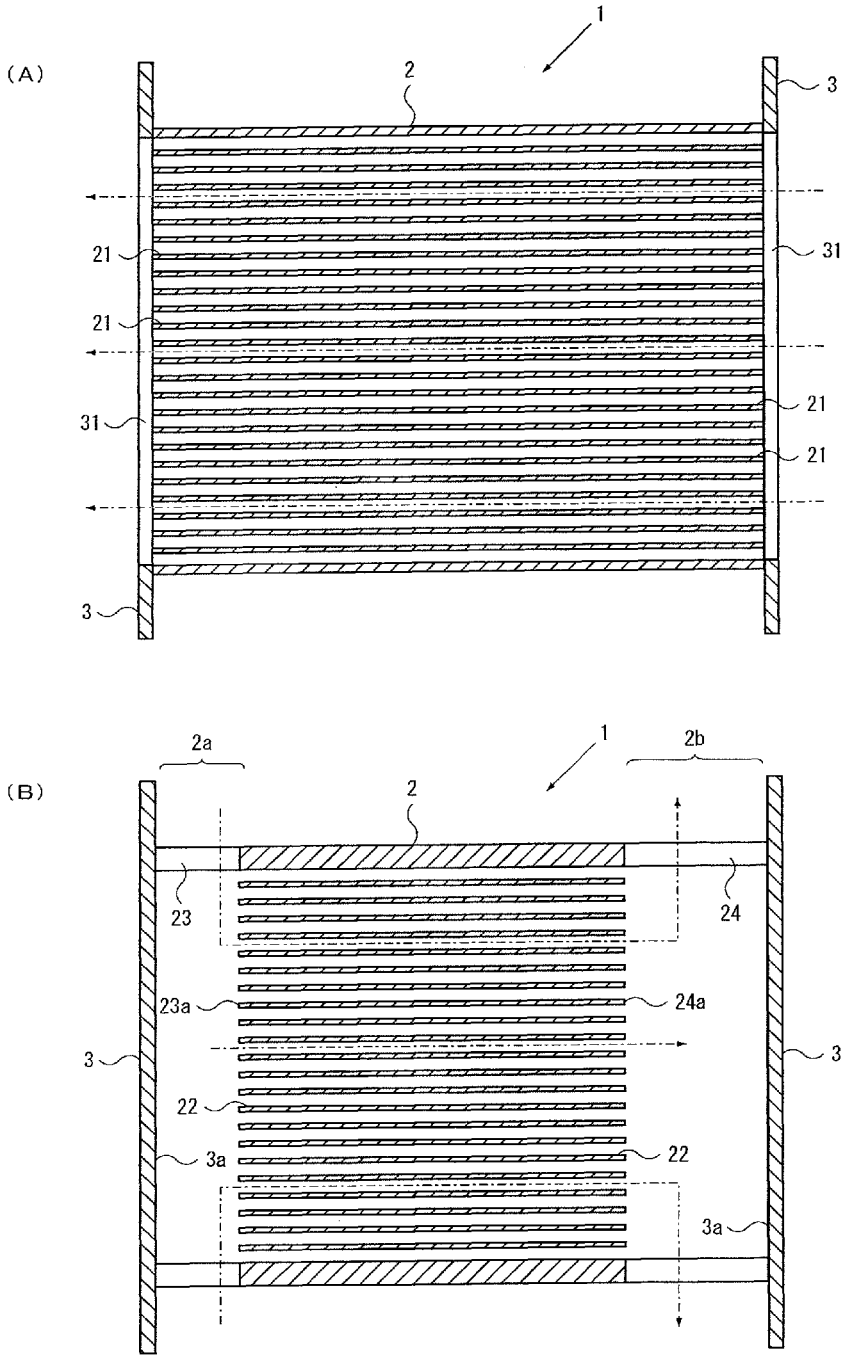

With reference to FIGS. 1 to 7, embodiments of the present invention will be described. FIG. 1 shows an embodiment of a ceramic heat exchanger according to the present invention, wherein FIG. 1(A) is a side view and FIG. 1(B) is a view as viewed in the direction of arrow B in FIG. 1(A). FIG. 2 shows cross-sectional views of the ceramic heat exchanger shown in FIG. 1(A), wherein FIG. 2(A) is a cross-sectional view along line SA-SA and FIG. 2(B) is a cross-sectional view along line SB-SB.

The ceramic heat exchanger 1 shown in FIGS. 1 and 2 is made of ceramic and intended to force a first medium and a second medium different in temperature (hereinafter referred to as "high-temperature medium" and "low-temperature medium", respectively) to flow in opposite directions to transfer heat from the high-temperature medium to the low-temperature medium. The ceramic heat exchanger 1 comprises a body 2 having first channels 21 for the high-temperature medium to flow and second channels 22 for the low-temperature medium to flow, and lids 3 each having openings 31, joined to the body 2 at opposite ends 2*a*, 2*b*, with the openings 31 connected to the first channels 21. The body 2 further has inlet channels 23 formed in a first channel 21 outlet-side end portion 2*a* to allow the low-temperature medium to enter the body at a side thereof and flow into the second channels 22, and outlet channels 24 formed in a first channel 21 inlet-side end portion 2*b* to allow the low-temperature medium to flow out of the second channels 22 and leave the body at the side thereof.

The body 2 is intended to force the high-temperature medium and the low-temperature medium to flow through in opposite directions. Specifically, as seen in FIGS. 1 and 2, the body 2 is a cylinder-shaped sintered ceramic block having a plurality of axial through-holes. The through-holes form a grid structure, for example, as seen in FIG. 1(B), wherein through-holes in every second row are first channels 21 or second channels 22 so that the rows of the first channels 21 alternate with the rows of the second channels 22.

The sintered ceramic block forming the body 2 may be made using oxide ceramics such as alumina and zirconia, or non-oxide ceramics such as silicon carbide. Oxide ceramics are superior in oxidation resistance at high temperatures, while non-oxide ceramics are superior in mechanical properties at high temperatures because of their low coefficients of thermal expansion. In order to improve the ceramic heat exchanger performance, it is desirable to make the body 2 using silicon carbide which has high thermal conductivity and high high-temperature strength.

As seen in FIG. 2(A), the first channels 21 are through-holes extending over the entire axial length of the body 2, in which the high-temperature medium flows parallel to the axis of the body 2. Specifically, the high-temperature medium enters the body 2 at the end portion 2*b*-side end of the body 2, and leaves the body 2 at the end portion 2*a*-side end of the body 2.

As seen in FIG. 2(B), the second channels 22 are through-holes axially extending between the end portions 2*a*, 2*b* of the body 2, in which the low-temperature medium flows parallel to the axis of the body 2, in the direction opposite to the direction of flow of the high-temperature medium. The inlet channels 23 are provided upstream of the second channels 22 (in the end portion 2*a*), while the outlet channels 24 are provided downstream thereof (in the end portion 2*b*). Thus, the low-temperature medium enters the body 2 at the side thereof, in the regions of the end portion 2*a*, then flows through the second channels 22, and then leaves the body 2 at the side thereof, in the region of the end portion 2*b*.

The inlet channels 23 and the outlet channels 24 are grooves 23*a*, 24*a* formed in the body 2 and delimited by an inner side 3*a* of the lid 3, the grooves extending transversely across the body and connecting to the second channels 22. As seen from FIGS. 1(A) and 1(B), each groove 23*a*, 24*a* extends across the body 2, and thus, over its associated row of the second channels 22. Further, as seen from FIG. 1(A), the grooves 23*a*, 24*a* have depths Da, Db varying depending on their positions. The depths Da, Db of the grooves 23*a*, 24*a* are each determined depending on the sum of the cross-sectional areas of the second channels 22 in the row associated with the groove concerned, for example, so that the grooves 23*a*, 24*a* in the middle of the body have greater depths Da, Db and the grooves 23*a*, 24*a* near the top or bottom of the body have smaller depths Da, Db so that the low-temperature medium can be uniformly distributed to the second channels 22.

As seen from FIG. 2(B), the inlet channels 23 and the outlet channels 24 function also as buffer spaces upstream and downstream of the second channels 22. The low-temperature medium enters the inlet channels 23 in the body 2, and then, while flowing in the second channels 22, absorbs heat from the high-temperature medium, via the walls separating the first and second channels. The low-temperature medium thus warmed up leaves the body 2 via the outlet channels 24. The low-temperature medium reaching the outlet channels 24 is therefore thermally-expanded compared with that entering the body 2. Thus, the outlet channels 24 are provided to be greater in capacity than their associated inlet channels 23. In other words, each pair of grooves 23*a*, 24*a* providing an inlet and an outlet channels 23, 24 have depths Da, Db satisfying Db>Da.

The lids 3 are joined to the body 2 at the opposite ends. The lids 3 have a function of separating the first channels 21 from second channels 22. Specifically, as seen in FIGS. 1 and 2, the lids 3 are disc-shaped sintered ceramic blocks greater in diameter than the body 2, and have openings 31 corresponding to the rows of the first channels 21, the shape of each opening being in agreement with the outline of its associated row of the first channels. The lids 3 are made of a ceramic material containing silicon nitride or silicon carbide as a main constituent, for example, although not restricted to it. Desirably, the lids 3 and the body 2 are made of the same ceramic material. The lids 3 are not restricted to the illustrated disc shape; they may be in other shapes including a rectangular shape, a round-cornered rectangular shape, an elliptical shape, and a polygonal shape. The lids 3 may have a shape suitable for a component to which the ceramic heat exchanger 1 is to be fitted.

The openings 31 are provided in the lids 3 to connect to their associated rows of the first channels 1 and connect to no second cannel 22, no inlet channel 23 and no outlet channel 24. In FIG. 1(B), each opening 31 has a rectangular shape in agreement with the outline of its associated row of the first channels 21. The openings are however not restricted to this shape. The openings may be provided such that most of the openings have substantially the same length.

Figure 3:
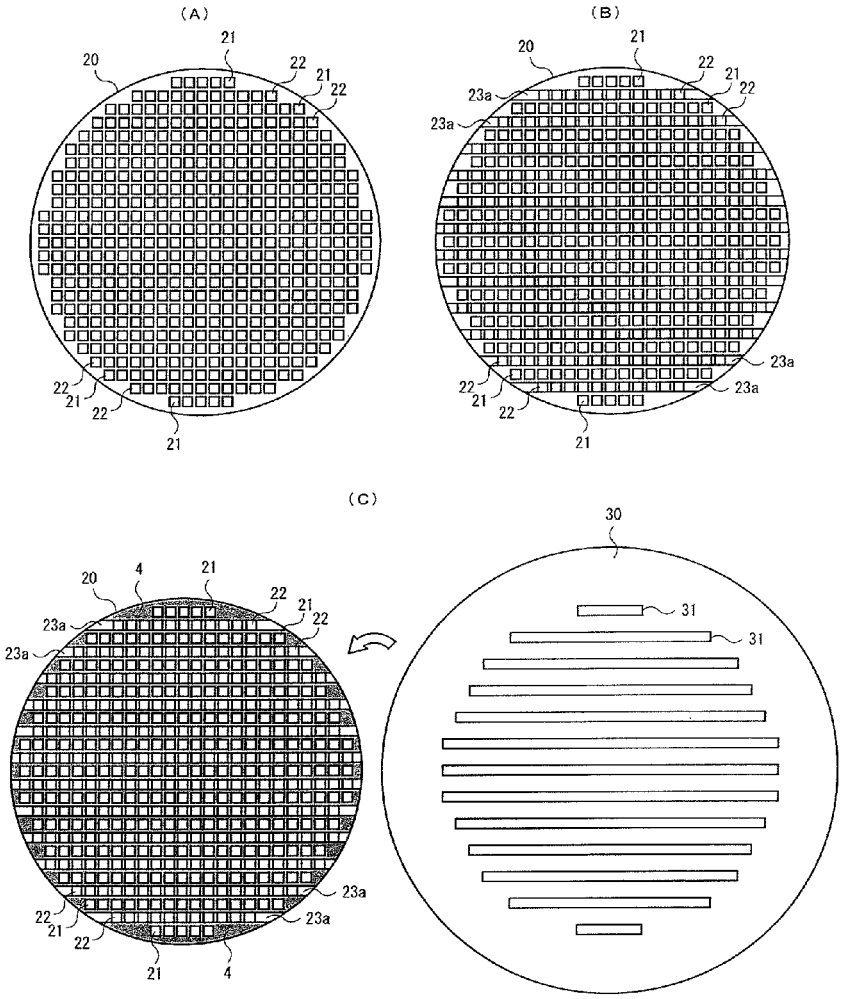

Next, the method of producing the ceramic heat exchanger 1, according to the present invention will be described. FIG. 3 shows sintered blocks obtained by the ceramic heat exchanger production method according to the present invention, wherein FIG. 3(A) shows a body-forming sintered block after a sintering step, FIG. 3(B) shows the body-forming sintered block after a working step, and FIG. 3(C) shows the body-forming sintered block after an application step and a lid-forming sintered block to be joined to it. The end of the body 2 shown in FIGS. 3(A) to 3(C) is the inlet channel 23-side end.

The method of producing the ceramic heat exchanger 1, made of ceramic and intended to force a high-temperature medium and a low-temperature medium different in temperature to flow in opposite directions to transfer heat from the high-temperature medium to the low-temperature medium, according to the present invention, comprises a forming step of forming a body 2-forming shape having first channels 21 for the high-temperature medium to flow and second channels 22 for the low-temperature medium to flow, and lid-forming shapes each having openings 31 to be connected to the first channels 21, a sintering step of sintering the body 2-forming shape and the lid 3-forming shapes, thereby producing a body 2-forming sintered block 20 and lid 3-forming sintered blocks 30, a working step of creating grooves 23*a*, 24*a* connecting to the second channels 22, in opposite end portions 2*a*, 2*b* of the body 2-forming sintered block 20, transversely across the body 2-forming sintered block 20, an application step of applying a bonding agent 4 to joint surfaces of at least either the body 2-forming sintered block 20 or the lid 3-forming sintered blocks 30, and a heat treatment step of heat-treating the body 2-forming sintered block 20 with the lid 3-forming sintered blocks 30 placed on opposite ends thereof, with the openings 31 in agreement with the first channels 21, thereby integrating the body 2-forming sintered block 20 and the lid 3-forming sintered blocks 30 by virtue of the bonding agent 4.

The forming step is a step of forming a body 2-forming shape and lid 3-forming shapes. Specifically, the body 2-forming shape is created by preparing a clay by mixing ceramic powder, a binder and water by means of an agitation mixer such as a kneader, and extruding the clay through a die for forming a cylindrical shape having through-holes (first and second channels 21 and 22) in a grid array as shown in FIG. 3(A). The lid 3-forming shape is created by preparing a slurry by adding a binder to ceramic powder, then making the slurry into granules by spray drying granulation, packing the granules into a die for forming a disc shape having openings 31 as shown in FIG. 3(C), and applying pressure to the die under predetermined conditions. The forming is not restricted to the above-described method. The shapes may be created by employing isostatic pressing (rubber pressing) and cutting, or employing casting. Cutting may be performed on the shapes as necessary.

The case in which the ceramic material used is silicon carbide will be taken as an example. For the body 2, a clay suitable for extrusion is prepared by adding, to a silicon carbide primary material with 0.5 to 10 μm average particle size and 99 to 99.8% purity, carbon (C), boron (B) and sintering aids such as alumina ($Al_2O_3$), yttria ($Y_2O_3$) and magnesia (MgO), putting an appropriate amount of this material in an agitation mixer such as a kneader, together with a binder such as polyethyleneglycol or polyethylene oxide and water, and mixing. The body 2-forming shape is obtained by extruding the clay thus prepared, through the aforementioned die.

For the lid 3, a slurry is prepared by adding, to a silicon carbide primary material with 0.5 to 10 μm average particle size and 99 to 99.8% purity, carbon (C), boron (B) and sintering aids such as alumina ($Al_2O_3$), yttria ($Y_2O_3$) and magnesia (MgO), and also adding an appropriated amount of a binder such as polyethyleneglycol or polyethylene oxide. The slurry thus prepared is made into granules by spray drying granulation. The lid 3-forming shape is obtained by packing the granules into the aforementioned die and applying pressure to the die under predetermined conditions.

The sintering step is a step of sintering the body 2-forming shape and the lid 3-forming shapes, thereby producing a body 2-forming sintered block 20 and lid 3-forming sintered blocks 30. Specifically, by sintering the body 2-forming shape and the lid 3-forming shapes in a sintering furnace, with an atmosphere, a temperature and a retention time predetermined to be suitable for the ceramic powder used, there are obtained a body 2-forming cylinder-shaped sintered block 20 having through-holes (first and second channels 21 and 22) in a grid array as shown in FIG. 3(A) and lid 3-forming disc-shaped sintered blocks 30 having openings 31 as shown in FIG. 3(C).

The working step is a step of creating grooves 23*a*, 24*a* providing inlet and outlet channels 23 and 24. Specifically, the grooves 23*a*, 24*a* are created in the end portions 2*a*, 2*b* of the body 2 to each connect to its associated row of the second channels 22. The grooves 23*a*, 24*a* in the end portions 2*a*, 2*b* of the body 2 have depths Da, Db as seen in FIG. 1(A), for example. Generally, ceramic with high hardness and brittleness is difficult to work. The working step of the present invention however only requires cutting or grinding to be performed straightly across the body 2, in the regions of the end portions 2*a*, 2*b*. Such cutting or grinding is easy and allows the grooves 23*a*, 24*a* to be made in the body 2-forming sintered block 20 without causing breaks in the block 20. The body 2-forming sintered block 20 after the working step has an end portion 2*a*-side end shown in FIG. 3(B).

The application step is a step of applying a bonding agent 4 to joint surfaces of at least either the body 2-forming sintered block 20 or the lid 3-forming sintered blocks 30. The bonding agent 4 is a glassy glaze, for example. The bonding agent 4 is applied to the opposite ends, or joint surfaces of the body 2-forming sintered block 20, by using a brush or other means. The body 2-forming sintered block 20 after the application step has an end portion 2*a*-side end shown in FIG. 3(C), where the parts with the bonding agent applied are shaded. It is desirable to prevent the bonding agent 4 from flowing into the grooves 23*a* and second channels 22 when applying the bonding agent 4 to the body 2-forming sintered block 20. The bonding agent 4 may be applied to the inner side 3*a*, or joint surface of each lid 3-forming sintered block, with masks or other means applied as necessary. The bonding agent 4 may be applied to the joint surfaces of both the body 2-forming sintered block 20 and the lid 3-forming sintered blocks 30.

The heat treatment step is a step of integrating the body 2-forming sintered block 20 and the lid 3-forming sintered blocks 30 into a ceramic heat exchanger 1 shown in FIGS. 1 and 2. Specifically, the lid 3-forming sintered blocks 30 are placed on the opposite ends of the body 2-forming sintered block 2 with the bonding agent 4 applied, with the openings 31 in agreement with the rows of the first channels 21, and heat-treated so that the body 2-forming sintered block 20 and the lid 3-forming sintered blocks 30 are integrated by virtue of the bonding agent 4.

The joints made by heat treatment are liable to leak. The ceramic heat exchanger 1 produced by the above-described method according to the present invention has, however, a reduced number of joints made by heat treatment, namely only two of such joints at the opposite ends of the body 2, resulting in a reduced likelihood of leakage. Further, the body 2-forming sintered block 20 and the lid 3-forming sintered blocks 3 can be joined together easily by a reduced number of work steps, namely applying the bonding agent 4 to at least either the opposite ends of the body-2 forming sintered block 20 or the inner side 3*a* of each lid-3 forming sintered block 30, placing the lid 3-forming sintered blocks 30 on the opposite ends of the body 2-forming sintered block 20, with the openings 31 in agreement with the rows of the first channels 21, and heat-treating the blocks 20 and 30 thus assembled. Furthermore, the inlet and outlet channels 23, 24 for forcing the low-temperature medium to flow into and out of the second channels 22 are provided simply by creating the grooves 23*a*, 24*a* in the opposite end portions 2*a*, 2*b* of the body 2-forming sintered block 20 and joining the lid 3-forming sintered blocks 30 to the opposite ends of the block 20. The inlet and outlet channels 23, 24 can therefore be easily created employing only the techniques applicable to ceramic which is high in brittleness and thus difficult to work.

Figure 4:
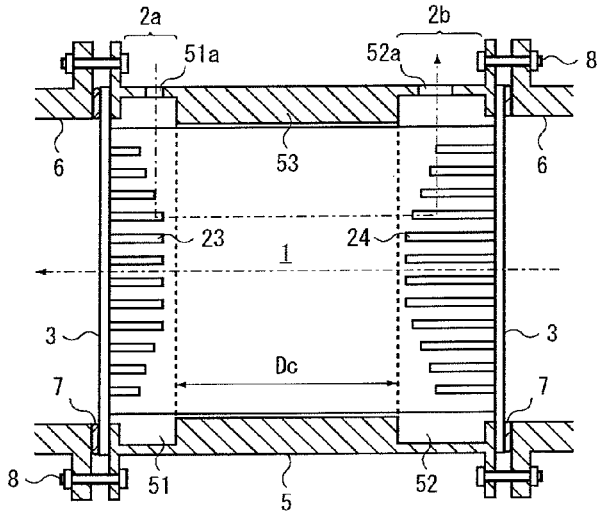
Figure 4:
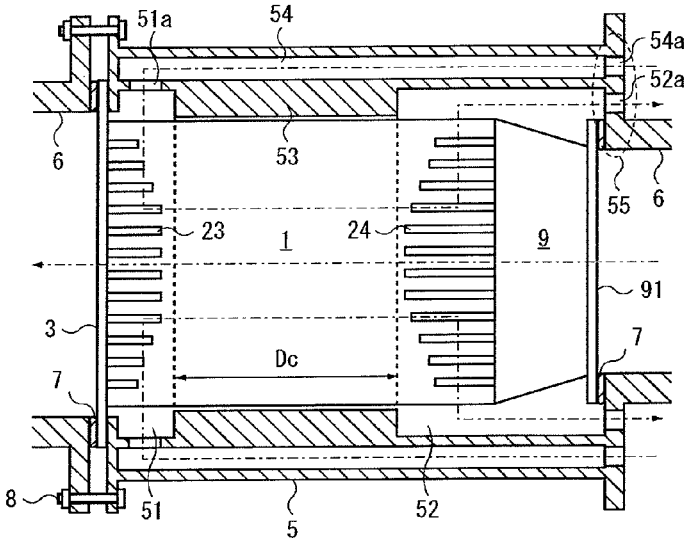

Next, exemplary applications of the ceramic heat exchanger 1 according to the present invention will be described. FIG. 4 shows applications of the ceramic heat exchanger according to the present invention, wherein FIG. 1(A) shows a first application and FIG. 1(B) a second application. The same components as those shown in FIGS. 1 and 2 are given the same reference characters to omit repetitive explanation.

In the applications of the ceramic heat exchanger 1 shown in FIGS. 4(A) and 4(B), a cylindrical member 5 is arranged over the body 2. The cylindrical member 5 provides an inlet chamber 51 connecting to the inlet channels 23 and having an inlet 51*a* for the low-temperature medium to flow in, and an outlet chamber 52 connecting to the outlet channels 24 and having an outlet 52*a* for the low-temperature medium to flow out.

In the first application shown in FIG. 4(A), the low-temperature medium enters and leaves the ceramic heat exchanger 1 at the side thereof. Specifically, the cylindrical member 5 is arranged over the ceramic heat exchanger 1, between the lids 3. Conduits 6 for conveying the high-temperature medium are fastened to the cylindrical member, at the opposite ends, by using fastening members such as bolts 8. An elastic member 7 is inserted between the lid 3 and the conduit 6. Typically, the cylindrical member 5 and the conduits 6 are made of metal, so that there is likely to be produced a difference in thermal expansion between these members and the ceramic heat exchanger 1. The elastic member 7 is provided to absorb such difference in thermal expansion. The elastic member 7 may be a rubber member capable of providing good sealing performance. If the sealing performance is ensured by another means, the elastic member may be a spring.

The cylindrical member 5 has an annular raised portion 53 inside, which delimits the inlet chamber 51 and the outlet chamber 52. The inside diameter of the annular raised portion 53 is slightly greater than the outside diameter of the body 2 of the ceramic heat exchanger 1, to ensure a space for allowing difference in thermal expansion between the ceramic heat exchanger 1 and the cylindrical member 5. The annular raised portion 53 has, for example a width, or axial length Dc ensuring that the annular raised portion does not overlap the inlet channels 23 or the outlet channels 24, as seen in FIG. 4(A). It may, however, be arranged such that each inlet channel 23 and its associated outlet channel 24 are equal in capacity (depth Da of each groove 23*a* equals depth Db of its associated groove 24*a*), and that the buffer capacities provided by the inlet channels 23 and the outlet channels 24 are determined by how much the annular raised portion 53 overlaps the inlet channels 23 and the outlet channels 24 (position and axial length Dc of the annular raised portion 53). The cylindrical member 5 is, for example made up of a plurality of separate axial parts, which are arranged over the body 2 of the ceramic heat exchanger 1 and hermetically joined together. The inlet chamber 51 and the outlet chamber 52 may have a single inlet 51*a* and a single outlet 52*a*, respectively, or circumferentially-distributed two or more inlets 51*a* and circumferentially-distributed two or more outlets 52*a*, respectively.

In the above-described first application, the high-temperature medium axially enters the first channels 21 in the ceramic heat exchanger 1, at the end portion 2*b*-side, or outlet channel 24-side end, and leaves the ceramic heat exchanger 1 at the end portion 2*a*-side, or inlet channel 23-side end. The low-temperature medium, on the other hand, enters the inlet chamber 51 through the inlet 51*a* in the cylindrical member 5, then enters the inlet channels 23 open at the side of the ceramic heat exchanger 1, then enters the second channels 22 and absorbs heat from the high-temperature medium while flowing in the second channels 2, and then leaves the ceramic heat exchanger 1 through the outlet channels 24, the outlet chamber 52 and the outlet 52*a*. The high-temperature medium is exhaust gases of 800° C. or above, for example, while the low-temperature medium is compressed air of approximately 150 to 200° C. to be supplied to an engine such as an internal combustion engine, for example. Through the ceramic heat exchanger 1 according to the present invention, the low-temperature medium, or compressed air is heated to approximately 500° C., for example.

In the second application shown in FIG. 4(B), the low-temperature medium enters and leaves the ceramic heat exchanger 1, axially. Specifically, the ceramic heat exchanger 1 has a lid in the form of a flanged adapter 9 having diameter reducing toward the high-temperature medium inlet side, and a cylindrical member 5 is arranged to extend from the high-temperature medium outlet-side lid 3 beyond the flange 91 of the adapter 9. Conduits 6 for conveying the high-temperature medium are connected to the cylindrical member 5 at the opposite ends. The adapter 9 is a truncated-conical annular member, for example. The adapter 9 is made using a ceramic material similar to that used for the ceramic heat exchanger 1, for example, and joined to the body 2 by bonding. If the adapter 9 is made of a metal, the adapter may be connected to the body 2 by fastening members such as bolts.

As in the first application, the cylindrical member 5 with an annular raised portion 53 provides an inlet chamber 51 with an inlet 51*a*, and an outlet chamber 52 with an outlet 52*a*. In the second application, the cylindrical member 5 also provides a low-temperature medium flow-in passage 54 outside the inlet chamber 51 and the outlet chamber 52. Specifically, the cylinder member 55 is a double-walled member defining an inner and an outer spaces, where the outer space serves as a low-temperature medium flow-in passage 54, while the inner space holds the ceramic heat exchanger 1 and provides a low-temperature medium flow-out passage (outlet chamber 52). The cylindrical member 5 also has an annular inward projection 55 at the high-temperature medium inlet-side end. In this annular projection 55, an axially-oriented entry 54*a* to the flow-in passage 54 and an axially-oriented exit 52*a* from the flow-out passage 52 are formed. The annular projection 55 and the flange 91 of the adapter 9 are joined with an elastic member 7 inserted between, and the high-temperature medium inlet-side conduit 6 is joined integrally to the annular projection 55. This configuration allows the ceramic heat exchanger 1 to be fitted between the high-temperature medium conduits 6 only by inserting the ceramic heat exchanger 1 in the cylindrical member 5 from the high-temperature medium outlet-side until it butts against the annular projection 55, and fastening the conduit 6 and the cylindrical member 5 together using fastening members 8.

In the above-described second application, the high-temperature medium axially enters the first channels 21 in the ceramic heat exchanger 1 via the adapter 9, and leaves the ceramic heat exchanger 1 at the end portion 2*a*-side, or inlet channel 23-side end. The low-temperature medium, on the other hand, enters the flow-in passage 54 through the entry 54*a*, then enters the inlet chamber 51 through the inlet 51*a*, then enters the inlet channels 23 open at the side of the ceramic heat exchanger 1, then enters the second channels 22, and while flowing in the second channels 22, absorbs heat from the high-temperature medium, and leaves the ceramic heat exchanger through the outlet channels 24, the outlet chamber 52 and the outlet 52*a*.

The above-described first and second applications are examples in which the low-temperature medium flows in and out of the cylindrical member 5 at the side thereof, transversely, or at the high-temperature medium inlet-side end thereof, axially. The present invention is however not restricted to such examples. For example, it may be arranged such that the low-temperature medium flows in and out at the high-temperature medium outlet-side end of the cylindrical member, axially, or flows in at the side of the cylindrical member transversely and flows out at an end of the cylindrical member axially or vice versa, or flows in at the high-temperature medium outlet-side end of the cylindrical member and flows out at the high-temperature medium inlet-side end thereof, axially.

Figure 5:
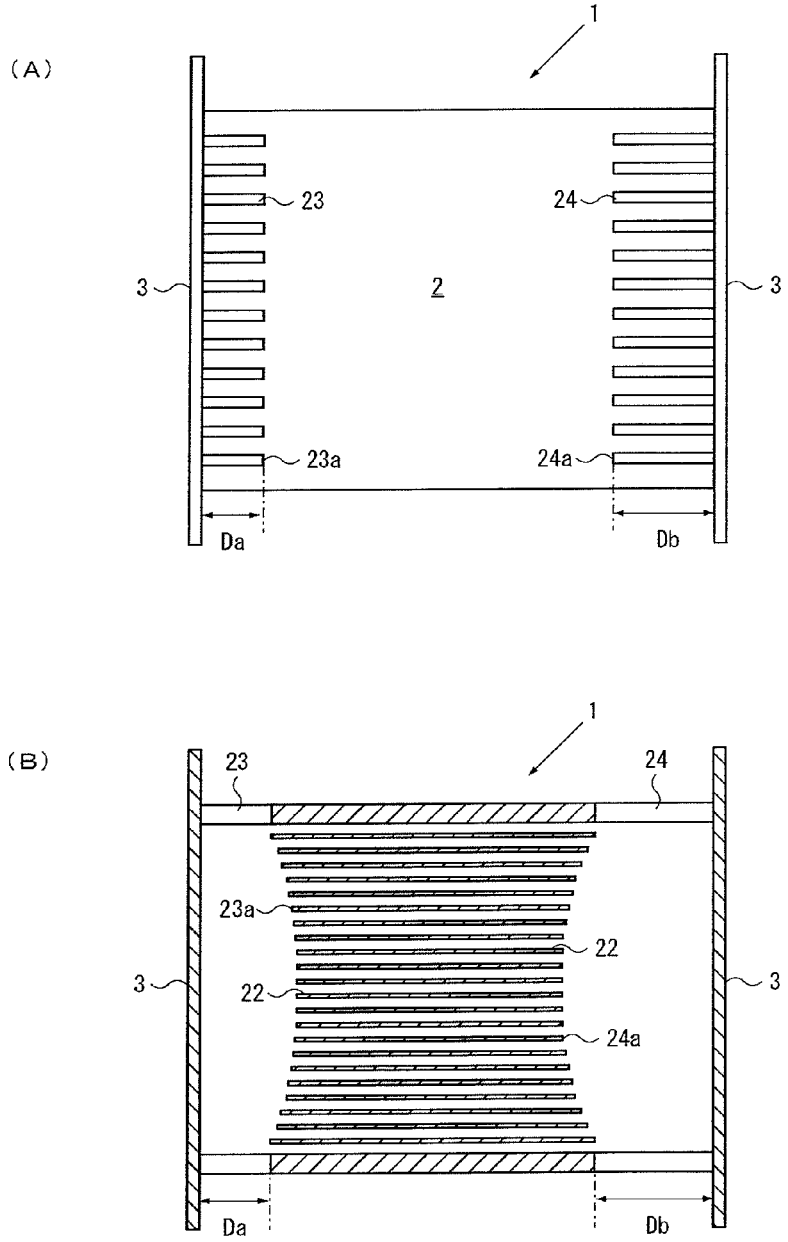
Figure 6:
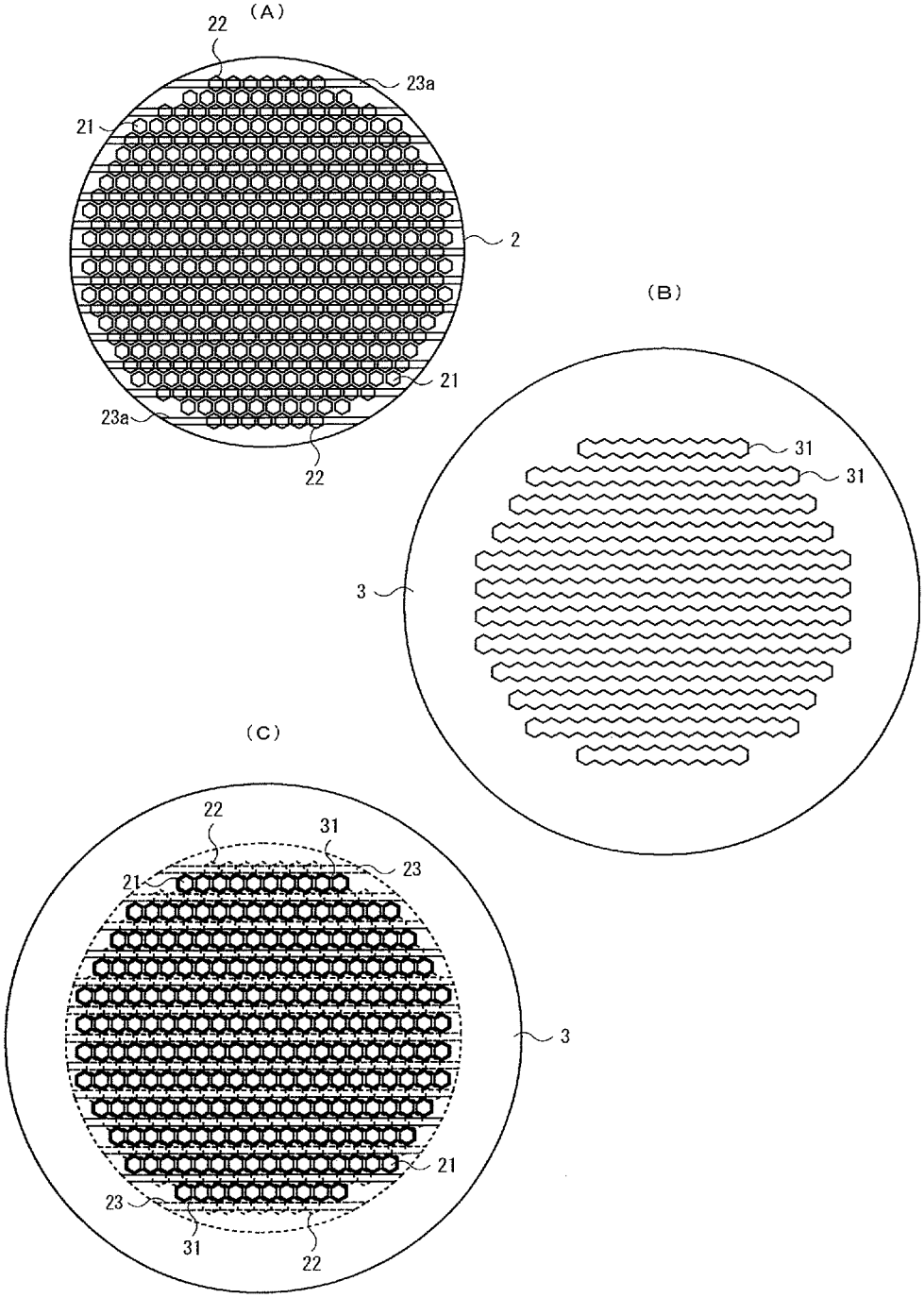

Next, variants of the ceramic heat exchanger 1 according to the present invention will be described. FIG. 5 shows variants of the ceramic heat exchanger according to the present invention, wherein FIG. 5(A) is a side view showing a first variant and FIG. 5(B) is a cross-sectional view showing a second variant. FIG. 6 shows a third variant of the ceramic heat exchanger according to the present invention, wherein FIG. 6(A) shows an end face of a ceramic heat exchanger, FIG. 6(B) shows an end of a body, and FIG. 6(C) shows a face of a lid. In these Figures, the same components as those shown in FIGS. 1 and 2 are given the same reference characters to omit repetitive explanation.

In the first variant shown in FIG. 5(A), the grooves 23*a* providing the inlet channels 23 have the same depth Da, and the grooves 24*a* providing the outlet channels 24 have the same depth Db. How to provide the grooves 23*a*, 24*a* providing the inlet and outlet channels 23, 24 may be varied depending on design and/or use conditions. For example, the grooves 23*a*, 24*a* may be provided such that the grooves 23*a*, 24*a* in the middle of the body have smaller depths Da, Db and the grooves 23*a*, 24*a* near the top or bottom of the body have greater depths Da, Db.

The cross-sectional view of the second variant shown in FIG. 5(B) corresponds to the SB-SB cross-sectional view shown in FIG. 2(B). The inlet and outlet channels 23, 24 in the second variant are provided by grooves 23*a*, 24*a* each curved such that the depth Da, Db of the groove is greatest at the center of the length of the groove. The curvatures of the grooves 23*a*, 24*a* are each determined depending on the sum of the cross-sectional areas of the second channels 22 in the row associated with the groove concerned and the opening area, or length multiplied by width of the groove concerned, for example, so that the low-temperature medium can be uniformly distributed to the second channels 22. The grooves 23*a*, 24*a* providing the inlet and outlet channels 23, 24 may be each curved such that such that the depth Da, Db of the groove is smallest at the center of the length of the groove, or inclined such that the depth Da, Db of the groove decreases or increases from one end to the other of its length. In sum, the shapes of the grooves 23*a*, 24*a* providing the inlet and outlet channels 23, 24 may be varied depending on the design and/or use conditions.

In the third variant shown in FIG. 6, the body 2 has through-holes forming a honeycomb structure. As seen in FIG. 6(A), the through-holes hexagonal in cross-section form a honey comb structure, where through-holes in every second row are first channels 21 or the second channels 22 so that the rows of the first channels 21 alternate with the rows of the second channels 22. Further, grooves 23*a* providing inlet channels 23 are formed in the body to extend transversely across the body and connect to the second channels 22 for the low-temperature medium to flow. Each groove 23*a* is formed to penetrate the vertical ones of the walls defining the hexagonal second channels 22 so as not to connect to the first channels 21. Although not depicted, the outlet channels 24 are formed in the same way.

As shown in FIG. 6(B), the lid 3 has openings 31 to be connected to the first channels 21 for the high-temperature medium to flow. The shape of each opening 31 is in agreement with the outline of its associated row of the first channels 23. As shown in FIG. 6(C), the lid 3 is joined to the body 2 shown in FIG. 6(A) so that the high-temperature medium enters and leaves the first channels 21 in the body 2 through the openings in the lids 3 while the low-temperature medium enters and leaves the body 2 at the side thereof and flows in the second channels 2 in the direction opposite to the direction of the high-temperature medium. As regards the arrangement of the other parts, the production method and the applications, the third variant is similar to the embodiment shown in FIGS. 1 to 4, and thus, a detailed explanation will be omitted.

Figure 7:
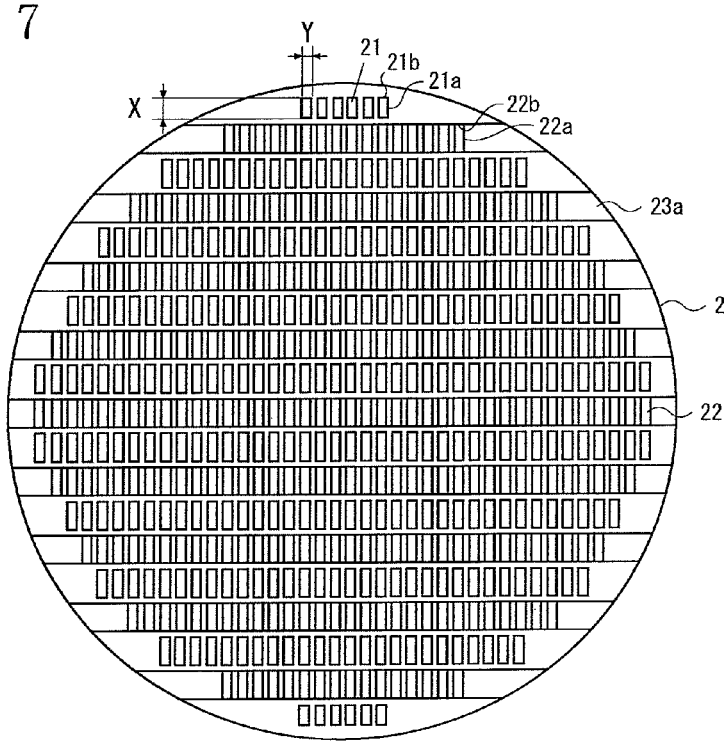
Figure 7:
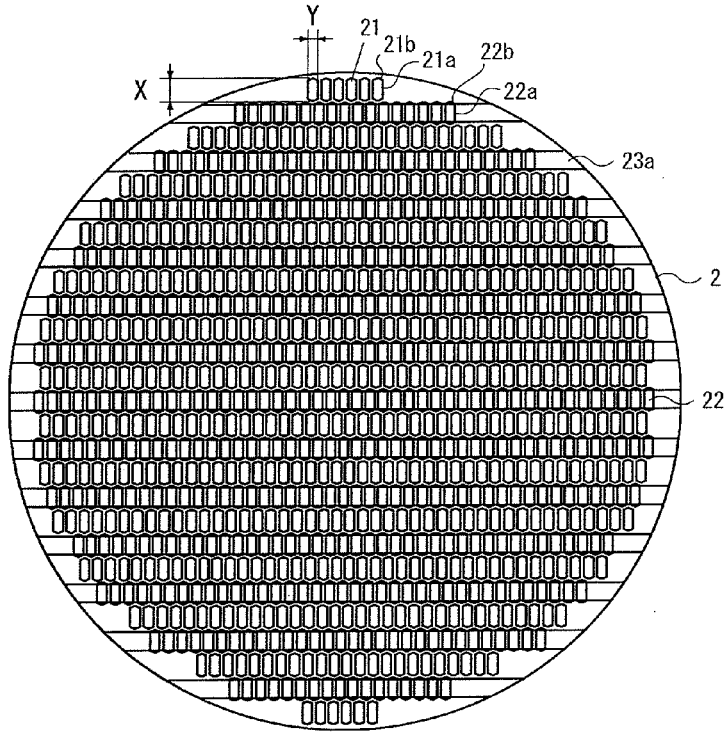

Further variants of the ceramic heat exchanger 1 according to the present invention will be described. FIG. 7 shows further variants of the ceramic heat exchanger according to the present invention, wherein FIG. 7(A) shows a fourth variant and FIG. 7(B) shows a fifth variant. Specifically, FIGS. 7(A) and 7(B) each shows an end of a body 2 of a ceramic heat exchanger 1 (with a lid 3 removed). In these Figures, the same components as those in the above-described embodiment are given the same reference characters to omit repetitive explanation.

In the fourth variant shown in FIG. 7(A), the first and second channels 21, 22 have a rectangular cross-section. Specifically, each first channel 21 has a cross-section shape consisting of a pair of long sides 21*a* and a pair of short sides 21*b*, while each second channel 22 has a cross-section shape consisting of a pair of long sides 22*a* and a pair of short sides 22*b*. This channel formation leads to a reduced number of walls separating the channels, and thus, ease of working and a reduced weight of the heat exchanger. This also leads to a reduced heat transfer area between the first and second channels 21, 22 and a reduced hydraulic diameter (quantity used in calculating heat transfer with regard to non-circular channels), and thus, an improved heat transfer effectiveness.

As seen in the Figure, the first and second channels 21, 22 have a rectangular cross-section shape with a long side X and a short side Y, where the ratio of the long side X to the short side Y (X/Y) is set between 1.2 and 3.0. The cross-section shape with a ratio X/Y less than 1.2 is difficult to create due to great working resistance. The cross-section shape with a ratio X/Y greater than 3.0 is susceptible to deformation, because of high likelihood of shrinkage of the long side X compared with the short side Y. Although in the described example, the first and second channels 21, 22 are identical in cross-section shape, the first and second channels 21, 22 may have different X/Y ratios. The first and second channels 21, 22 may be square and rectangular in cross-section shape, respectively, or vice versa.

In the fifth variant shown in FIG. 7(B), the first and second channels 21, 22 have a hexagonal cross-section shape consisting of long sides X and short sides Y. Specifically, each first channel 21 has a cross-section shape consisting of a pair of long sides 21*a* and two pairs of short sides 21*b*, while each second channel 22 has a cross-section shape consisting of a pair of long sides 22*a* and two pairs of short sides 22*b*. This channel formation leads to a reduced number of walls separating the channels, and thus, ease of working and a reduced weight of the heat exchanger. This also leads to a reduced heat transfer area between the first and second channels 21 and 22 and a reduced hydraulic diameter (quantity used in calculating heat transfer with regard to non-circular channels), and thus, an improved heat transfer effectiveness. The ratio of the long side X to the short side Y is set as in the fourth variant shown in FIG. 7(A), although repetitive explanation is omitted.

The present invention is not restricted to the above-described embodiments. Each embodiment is modified in various ways without departing from the scope and spirit of the present invention. For example, the third variant may be modified by introducing features of the first or second variant.

The invention claimed is:

1. A ceramic heat exchanger made of a ceramic, for forcing a first medium and a second medium, different in temperature, to flow in opposite directions to transfer heat between the first and second media, comprising:

a body having first channels for the first medium to flow and second channels for the second medium to flow disposed axially in the body with second channels defined in top, middle and bottom portions of the body, and lids each having openings, joined to axially opposite ends of the body with the openings connected to the first channels, wherein:

the body further having inlet channels formed in a first channel outlet-side end portion to allow the second medium to enter the body at a side thereof and flow into the second channels, and outlet channels formed in a first channel inlet-side end portion to allow the second medium to flow out of the second channels and leave the body at the side thereof, the inlet channels as well as the outlet channels being grooves formed in the body and delimited by an inner side of the lid, the grooves extending transversely across the body and connecting to respective second channels in the top, bottom and middle portions of the body, and the grooves connecting the second channels in the middle portion of the body have greater dimensions in the axial direction of the body than the grooves connecting the second channels in the top and bottom portions of the body.

2. The ceramic heat exchanger according to claim 1, wherein the first and second channels form alternating rows.

3. The ceramic heat according to claim 1, wherein the first and second channels form a grid or honeycomb structure.

4. The ceramic heat exchanger according to claim 3, wherein the first and second channels have a cross-section shape consisting of long and short sides.

5. The ceramic heat exchanger according to claim 4, wherein the ratio of the long side to the short side of the cross-section shape is between 1.2 and 3.0.

6. The ceramic heat exchanger according to claim 1, wherein the outlet channels are greater in capacity than the inlet channels.

7. The ceramic heat exchanger according to claim 1, further comprising a cylindrical member arranged over the body, the cylindrical member providing an inlet chamber connecting to the inlet channels and having an inlet for the second medium to flow in, and an outlet chamber connecting to the outlet channels and having an outlet for the second medium to flow out.

* * * * *